US009058794B2

(12) United States Patent
Kugo

(10) Patent No.: US 9,058,794 B2
(45) Date of Patent: Jun. 16, 2015

(54) TOOLS FOR BOWED STRING MUSICAL INSTRUMENTS

(76) Inventor: Hiroshi Kugo, Florence (IT)

( * ) Notice: Subject to any disclaimer, the term of this patent is extended or adjusted under 35 U.S.C. 154(b) by 0 days.

(21) Appl. No.: 14/114,824

(22) PCT Filed: May 4, 2012

(86) PCT No.: PCT/IT2012/000131
§ 371 (c)(1),
(2), (4) Date: Oct. 30, 2013

(87) PCT Pub. No.: WO2012/150616
PCT Pub. Date: Nov. 8, 2012

(65) Prior Publication Data

US 2014/0060282 A1 Mar. 6, 2014

(30) Foreign Application Priority Data

May 5, 2011 (IT) ..... FI20110028 U

(51) Int. Cl.
*G10D 3/14* (2006.01)
*G10D 1/00* (2006.01)
*G10D 3/12* (2006.01)

(52) U.S. Cl.
CPC ..... *G10D 3/14* (2013.01); *G10D 1/005* (2013.01); *G10D 3/12* (2013.01)

(58) Field of Classification Search
CPC ..... G10D 3/14; G10D 1/02
See application file for complete search history.

(56) References Cited

U.S. PATENT DOCUMENTS

| | | | | |
|---|---|---|---|---|
| 2,232,453 | A | 2/1941 | Harvey | |
| 2,674,912 | A * | 4/1954 | Petek | 84/275 |
| 3,096,676 | A | 7/1963 | Mosa et al. | |
| 3,880,040 | A * | 4/1975 | Kaman | 84/291 |
| 4,846,038 | A * | 7/1989 | Turner | 84/293 |
| 4,951,542 | A * | 8/1990 | Chen | 84/293 |
| 5,171,616 | A * | 12/1992 | Dejima | 428/22 |
| 5,171,926 | A | 12/1992 | Besnainou et al. | |
| 5,463,924 | A * | 11/1995 | Reuterfors | 84/304 |
| 5,998,713 | A * | 12/1999 | Herin | 84/305 |
| 6,018,120 | A * | 1/2000 | Steinberger | 84/731 |
| 6,627,802 | B1 * | 9/2003 | Jones | 84/290 |
| 6,703,545 | B2 * | 3/2004 | McFerson | 84/274 |
| 6,706,956 | B1 * | 3/2004 | Gotoh | 84/304 |
| 6,774,292 | B2 * | 8/2004 | Mace | 84/293 |
| 7,276,868 | B2 * | 10/2007 | Allred, III | 318/294 |
| 7,342,161 | B1 * | 3/2008 | Fox | 84/290 |
| 7,786,361 | B1 * | 8/2010 | Foltz | 84/291 |
| 7,795,515 | B2 * | 9/2010 | Bartholomew | 84/282 |

(Continued)

FOREIGN PATENT DOCUMENTS

| | | |
|---|---|---|
| DE | 196 45 519 A1 | 7/1997 |
| DE | 198 31 589 A1 | 1/2000 |

(Continued)

OTHER PUBLICATIONS

International Search Report, dated Sep. 6, 2012, from corresponding PCT application.

*Primary Examiner* — Robert W Horn
(74) *Attorney, Agent, or Firm* — Young & Thompson

(57) ABSTRACT

A tool for musical string instruments that is to be mounted in contact with a vibrating part of the instrument, made up of two stably coupled portions (11, 13; 16, 17; 25, 26, 27, 28), one made of wood, the other made of a material different from wood.

8 Claims, 4 Drawing Sheets

(56) References Cited

U.S. PATENT DOCUMENTS

| | | | | |
|---|---|---|---|---|
| 7,816,594 | B2 * | 10/2010 | Vochezer | 84/305 |
| 8,110,729 | B2 * | 2/2012 | Guthrie et al. | 84/298 |
| 8,383,921 | B2 * | 2/2013 | Yamamoto et al. | 84/325 |
| 8,492,629 | B2 * | 7/2013 | Johnson | 84/280 |
| 8,759,649 | B2 * | 6/2014 | Potyrala | 84/293 |
| 2005/0217455 | A1 | 10/2005 | Ricci | |
| 2007/0095194 | A1 | 5/2007 | Moerth | |
| 2009/0025528 | A1 * | 1/2009 | Vochezer | 84/304 |
| 2009/0114075 | A1 | 5/2009 | Vochezer | |
| 2010/0132533 | A1 * | 6/2010 | Guthrie et al. | 84/298 |
| 2011/0247475 | A1 * | 10/2011 | Yamamoto et al. | 84/325 |
| 2012/0011982 | A1 * | 1/2012 | Johnson | 84/280 |
| 2012/0085217 | A1 * | 4/2012 | Threlkeld-Wiegand | 84/276 |
| 2012/0103171 | A1 * | 5/2012 | Lashbrook | 84/731 |
| 2013/0111757 | A1 * | 5/2013 | Yamamoto et al. | 29/896.22 |
| 2014/0060282 | A1 * | 3/2014 | Kugo | 84/304 |
| 2014/0144305 | A1 * | 5/2014 | Hellinge | 84/290 |
| 2014/0144306 | A1 * | 5/2014 | Seal | 84/291 |
| 2014/0295131 | A1 * | 10/2014 | Pilpel | 428/113 |

FOREIGN PATENT DOCUMENTS

| | | | |
|---|---|---|---|
| DE | 10 2006 007970 | A1 | 8/2007 |
| FR | 634 007 | A | 2/1928 |
| GB | 2 786 68 | A | 0/1927 |
| WO | 2004/107311 | A1 | 12/2004 |

* cited by examiner

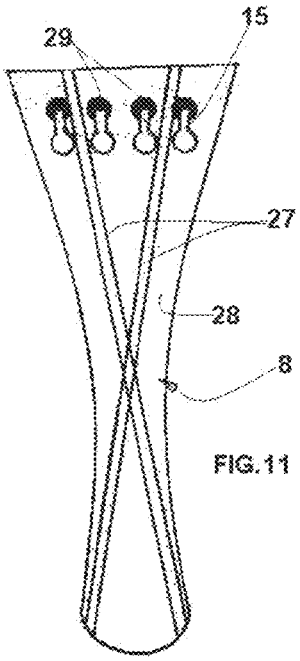
FIG.11
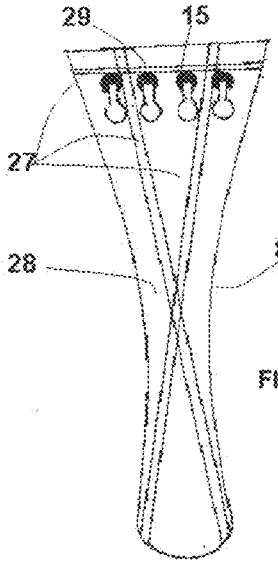
FIG.12
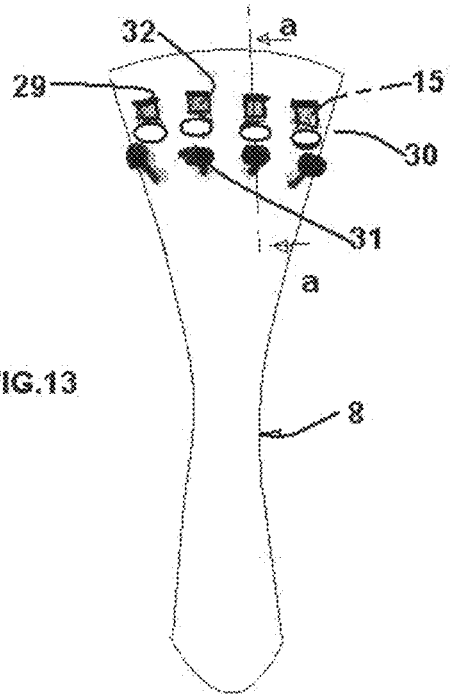
FIG.13
FIG.13a
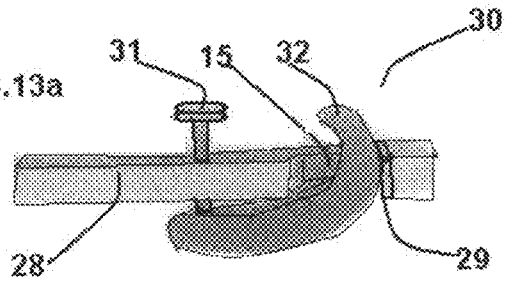

TOOLS FOR BOWED STRING MUSICAL INSTRUMENTS

TECHNICAL SECTOR

The present invention relates to an accessory, or tool, for musical string instruments, for example violins, violas, cellos, double basses, etc.

In greater detail, it regards an accessory that when the instrument used vibrates as a result of the vibrations of the strings, in turn affecting the acoustic result of the instrument.

Principally, the accessory in question is a tuning peg, but it may be constituted by the end button set at the base of the sound box or by the tailpiece that tensions the strings in co-operation with the pegs.

PRIOR ART

It is known that the physical and mechanical characteristics of the accessories mentioned above significantly affect the quality of the sound rendering it more or less soft or metallic.

For this reason, musicians are extremely careful in the choice of the accessories and the possibility of obtaining via an appropriate choice thereof a sound of different quality.

One of the characteristics that affects the acoustic response of the accessories is given by the material chosen to produce them, a choice that generally falls on different types of hard wood, such as for example rosewood, ebony, and box wood.

At the current state of the art, also known are accessories made up of a number of materials.

An example is provided in the patents Nos. EP0798692 and U.S. Pat. No. 2,232,453, which describe pegs made of wood traversed by a core made of metal material.

Even though the structure in two components certainly affects in some way the acoustic effect of the accessory, the examples referred to above have in actual fact the function of varying the operations of tensioning of the string, but leave the problem of affecting the acoustic result in the desired way unsolved; rather, since they are made up of a number of parts mobile with respect to one another, they are not suitable for achieving the desired purpose.

PURPOSE OF THE INVENTION

With the present invention the aim is to overcome the drawbacks of the solutions already known.

SUMMARY OF THE INVENTION

The above purpose is achieved by providing an accessory for musical string instruments according to at least one of the annexed claims.

The main advantage of the invention lies in the possibility of affecting in the desired way the quality of the sound of the instrument by choosing an accessory that will respond to the effects that the musician wishes to achieve.

LIST OF THE DRAWINGS

The above and further advantages will be better understood by Any person skilled in the branch from the ensuing description and from the annexed drawings, which are provided by way of non-limiting example and in which:

FIG. 11-13 show a preferred embodiment of a tailpiece according to the invention; and FIG. 13*a* shows a detail in the longitudinal section a-a of the tailpiece of FIG. 13.

DETAILED DESCRIPTION

With reference to the annexed drawings, there now follows a description of an accessory for musical string instruments.

In the example described, generic reference will be made to the structure of a violin 1, provided with pegs 5 according to the invention, but it is understood that accessories according to the invention, such as the pegs, the end buttons, or the tailpieces, can be applied to musical string instruments of any type.

Figure 1:
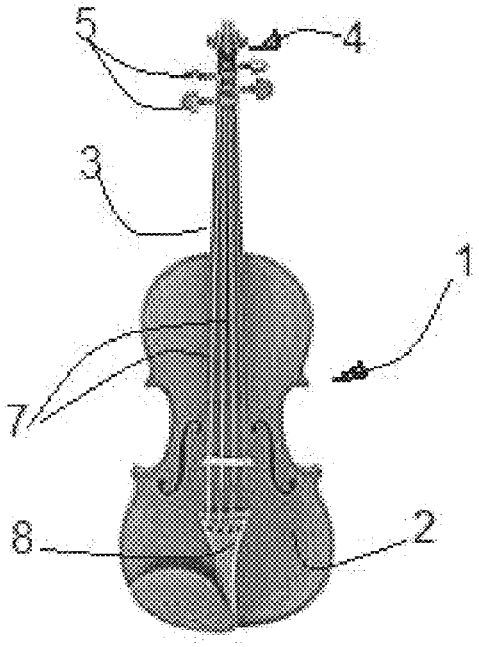
FIG. 1 shows a violin.
Figure 2:
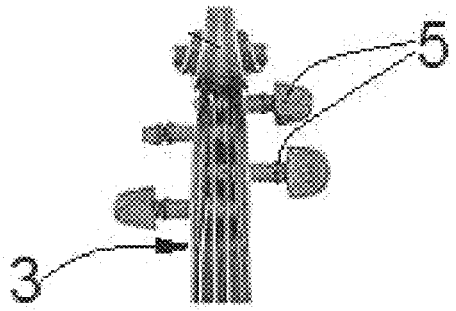
FIG. 2 shows a detail of the neck of the violin and of the pegs connected thereto.
Figure 3:
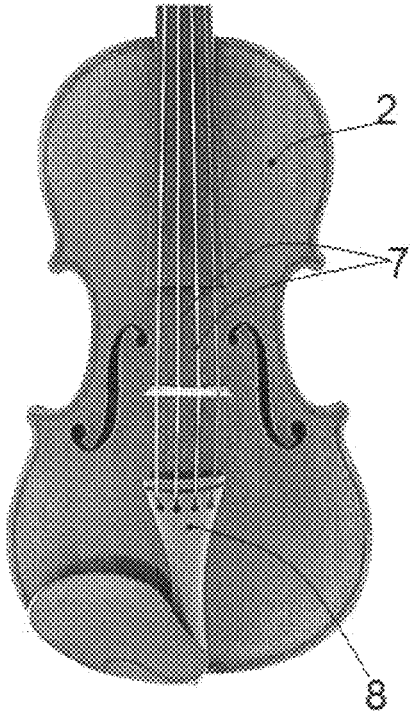
FIG. 3 shows a detail of the sound box of the violin and of a tailpiece connected thereto.
Figure 4:
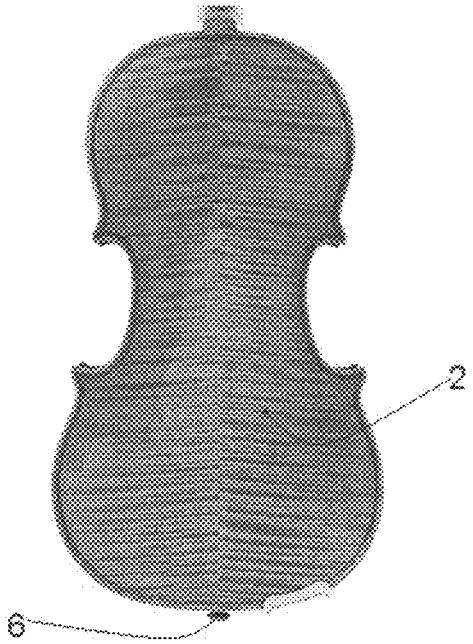
FIG. 4 shows a detail in rear view of the sound box and of the end button fixed thereto.

With reference to FIG. 1, a violin 1 is represented formed generically by a sound box 2 extending at the top from which is a neck 3 and which is provided at the bottom with an end button 6, visible in FIG. 4.

Provided at the end of the neck 3 is a pegbox 4 mounted on which are the pegs 5 that can turn with friction, each winding the end of a string 7.

At the opposite end with respect to the pegbox 4 the strings 7 are moreover connected to the engagement points 15 of a tailpiece 8 fixed to the sound box 2 with the bottom or tail portion 14, in such a way said that, by turning the pegs 5 the tension of the strings is adjusted and consequently it is possible to tune the instrument.

Figure 5:
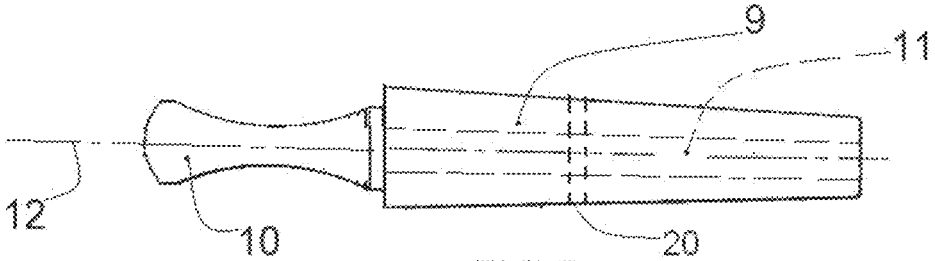
FIG. 5 shows in cross section a peg, provided by way of example of accessory according to the invention.
Figure 6:
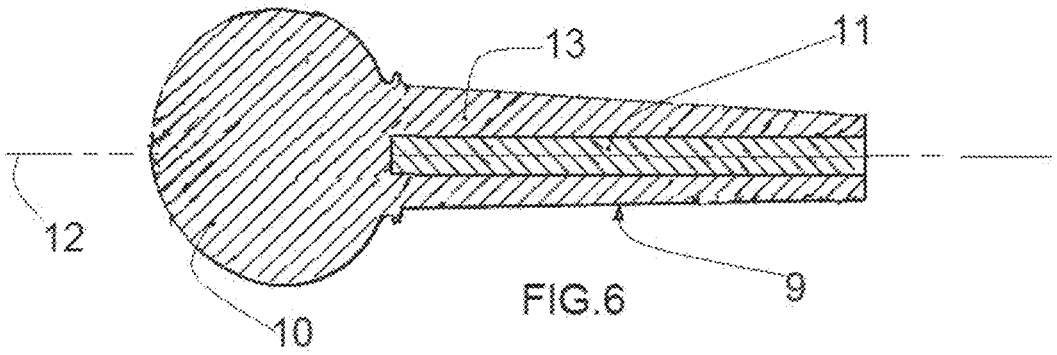
FIG. 6 shows the peg of FIG. 5 in cross-sectional view.

With reference to FIG. 5, a peg 5 according to the invention is described, comprising a generally frustoconical stem 9, with axis 12, which at the end of larger diameter terminates with a manual-gripping portion 10.

The peg 5 is made up of two parts, each made of a different material, and in particular a central core 11 surrounded by a peripheral portion 13.

The central portion 11 is made of a non-metal material, preferably selected from among carbon fibre, Kevlar, and composite materials in general, whilst the outer portion 13 is made of wood, also to enable easy machining thereof to reduce the diameter if need be.

In a preferred embodiment, the peg 5 is obtained by making the central bore corresponding to the portion 11, and then inserting the central portion 13 after applying a glue suitable for the materials chosen.

Advantageously, since the portion 13 is not made of metal material, it can be bored in a transverse direction to create the bore 20 for attachment of the string to the peg, without deviating the drill and damaging the peg, as would occur if a metal insert were used.

Figure 7:
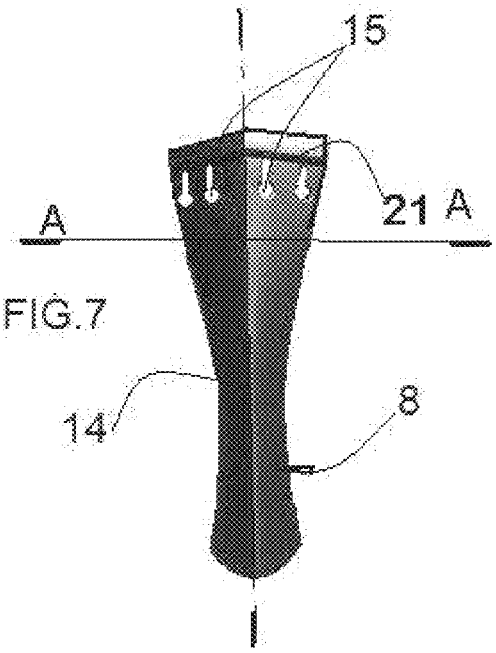
FIG. 7, 8 show in plan view and from above, respectively, a tailpiece according to the invention.
Figure 8:
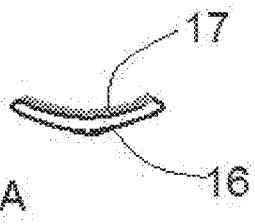

With reference to FIGS. 7 and 8 a tailpiece 8 according to the invention is described, made up of two layers 16, 17 stably coupled by gluing and obtained starting from different materials, in particular a layer of wood and a reinforcement layer made of carbon fibre, Kevlar, or composite materials in general.

The reinforcement layer 17 may advantageously be arranged on the inner side as shown in FIG. 8, or on the outer side of the tailpiece 8, or on both.

Preferably, the tailpiece 8 can have a string-rest reinforcement 21 made, for example, of carbon fibre, Kevlar, or composite materials in general.

Figure 10:
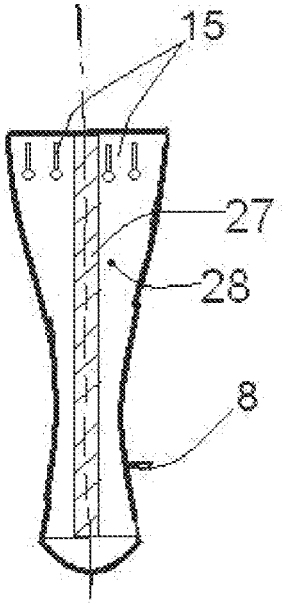
FIG. 10 shows a top-plan view of the inner hidden face of a tailpiece according to the invention.

Once again in FIGS. 10-12 further embodiments of the tailpiece 8 are illustrated, where a longitudinal reinforcement 27 made of carbon fibre, Kevlar, composite materials in general or even metals, such as titanium or magnesium, is glued or in any case coupled to the wooden body 28 of the tailpiece.

Advantageously, the reinforcement 27 may have a longitudinal rectilinear shape (FIG. 10) or assume different shapes, for example a generic V shape diverging towards the part of attachment of the strings to the tailpiece or an X shape (FIG. 11) possibly with a transverse reinforcement (FIG. 12).

Advantageously, FIGS. 11-13 show a tailpiece 8 in which the engagement points 15 for the strings 7 are provided with inserts 29 made of a material, in the point of contact with the strings, such as carbon fibre, Kevlar or composite materials in general, or even metals such as titanium or magnesium.

The inserts 29 may be provided in tailpieces without fine tuners, as shown in FIGS. 11 and 12, or in tailpieces provided with fine tuners 30, better represented schematically in FIGS. 13 and 13*a*, which illustrate a fine tuner with a tensioning screw 31 of a hook or tooth 32 capable of tensioning a string remaining resting upon the insert 29.

Figure 9:
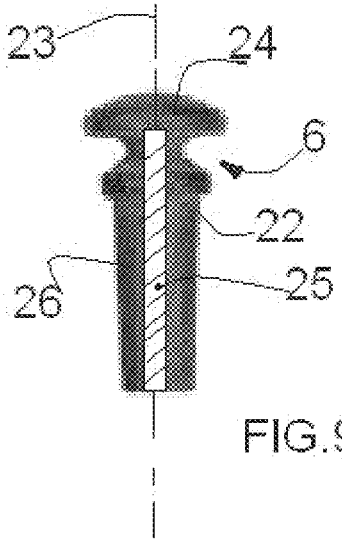
FIG. 9 shows an end button according to the invention.

With reference to FIG. 9, an end button 6 according to the invention is described, comprising a generally frustoconical stem 22, with axis 23, which at the end of larger diameter terminates with a resting portion 24.

The end button 6 is made up of two parts, each made of a different material, and in particular a central core 25 surrounded by a peripheral portion 26.

The central portion 25 is made of a metal or non-metal material, preferably selected from among steel, carbon fibre, Kevlar, and composite materials in general, whereas the outer portion 26 is made of wood.

In a preferred embodiment, the end button 6 is obtained by making the central bore corresponding to the portion 25, and then inserting therein the central portion 25 after applying a glue suitable for the materials chosen.

Advantageously, the choice of the materials and of the type of coupling chosen determines the quality of the sound, which may be produced according to the effect that the musician wishes to reproduce.

The present invention has been described according to preferred embodiments, but equivalent variants may be conceived without thereby departing from the sphere of protection granted.

The invention claimed is:

1. A tool for bowed musical string instruments, having portions that are to be mounted in contact with a vibrating part of the instrument, wherein said portions are it is made up of two stably coupled portions (11, 13; 16, 17; 25, 26, 27,28), one portion made of wood, the other portion made of a material different from wood chosen from among carbon fibre or a composite material, wherein said tool is a peg (5) comprising a generally frustoconical stem (9) that terminates at the end of larger diameter with a gripping portion (10), and wherein said peg (5) is made up of an outer portion (12) made of wood coupled by gluing to an inner portion made of a non-metal material chosen from among carbon fibre, kevlar or a composite material.

2. The tool according to claim 1, further comprising a tailpiece (8) designed to be connected to the sound box (2) of the instrument with a bottom or tail portion (14), and provided with engagement points (15) for the strings (7), the tailpiece being made up of two layers (16, 17) stably coupled and obtained starting from different materials, in particular a layer made of wood and a layer made of carbon fibre, or of composite materials.

3. The tool according to claim 2, wherein said tailpiece (6) is made up of an outer portion in view (16) made of wood glued to an inner portion (17) made of carbon fibre a material chosen from among carbon fibre, or composite materials.

4. The tool according to claim 2, wherein said tailpiece (6) comprises a string-rest reinforcement (21*a*) made of carbon fibre, or composite materials.

5. The tool according to claim 1, further comprising a tailpiece (8), which is designed to be connected to the sound box (2) of the instrument with a bottom or tail portion (14) and is provided with engagement points (15) for the strings (7), which are provided with inserts (29) made of a material, in the point of contact with the strings, such as carbon fibre, or composite materials.

6. A tool for bowed musical string instruments, having portions that are to be mounted in contact with a vibrating part of the instrument, wherein said portions are it is made up of two stably coupled portions (11, 13; 16, 17; 25, 26, 27,28), one portion made of wood, the other portion made of a material different from wood chosen from among carbon fibre or a composite material, wherein said tool is an end button (6), and wherein said end button (6) is made up of an outer portion (26) made of wood coupled by gluing to an inner portion (25) made of a material chosen from among carbon fibre, or a composite material.

7. A tool for bowed musical string instruments, having portions that are to be mounted in contact with a vibrating part of the instrument, wherein said portions are it is made up of two stably coupled portions (11, 13; 16, 17; 25, 26, 27,28), one portion made of wood, the other portion made of a material different from wood chosen from among carbon fibre or a composite material, wherein said tool is a tailpiece (8), which is designed to be connected to the sound box (2) of the instrument with a bottom or tail portion (14) and is provided with engagement points (15) for the strings (7), and comprises a reinforcement (27) made of carbon fibre, or composite materials, glued or in any case stably applied to the body (28) made of wood of the tailpiece.

8. A kit of tools comprising at least a peg (5), a tailpiece (8) according to the claim 2, and an end button (6) made up of an outer portion (26) made of wood coupled by gluing to an inner portion (25) made of a material chosen from among carbon fibre or a composite material.

* * * * *